US011542967B2

(12) United States Patent
Franzoni et al.

(10) Patent No.: US 11,542,967 B2
(45) Date of Patent: Jan. 3, 2023

(54) HYDRAULIC SYSTEM WITH AN ENERGY RECOVERY CIRCUIT

(71) Applicant: Dana Motion Systems Italia S.R.L., Reggio Emilia (IT)

(72) Inventors: Federica Franzoni, Reggio Emilia (IT); Nicola Francesco Musciagna, San Giovanni (IT); Fabio Natali, Modena (IT); Alessandro Sassi, Reggio Emilia (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 0 days.

(21) Appl. No.: 17/127,578

(22) Filed: Dec. 18, 2020

(65) Prior Publication Data

US 2021/0190095 A1 Jun. 24, 2021

(30) Foreign Application Priority Data

Dec. 20, 2019 (EP) ..... 19218465

(51) Int. Cl.
*F15B 21/14* (2006.01)
*E02F 9/22* (2006.01)

(52) U.S. Cl.
CPC ..... *F15B 21/14* (2013.01); *E02F 9/2217* (2013.01); *F15B 2211/30525* (2013.01); *F15B 2211/3144* (2013.01); *F15B 2211/329* (2013.01); *F15B 2211/40507* (2013.01); *F15B 2211/41572* (2013.01); *F15B 2211/6306* (2013.01);
(Continued)

(58) Field of Classification Search
CPC ..... F15B 21/14; F15B 2211/30525; F15B 2211/3144; F15B 2211/329; F15B 2211/40507; F15B 2211/41572; F15B 2211/6306; F15B 2211/6313; F15B 2211/6323; F15B 2211/665; F15B 2211/763; F15B 2211/88; E02F 9/2217
See application file for complete search history.

(56) References Cited

U.S. PATENT DOCUMENTS 5,184,466 A * 2/1993 Schniederjan ..... F16H 61/431 60/449
9,518,593 B2 * 12/2016 Mori ..... E02F 9/2232
(Continued)

FOREIGN PATENT DOCUMENTS

CN 106438525 A 2/2017
EP 2752586 A1 7/2014
(Continued)

OTHER PUBLICATIONS

European Patent Office, Extended European Search Report Issued in Application No. 19218465.3, dated Jul. 16, 2020, Germany, 11 pages.

*Primary Examiner* — Dustin T Nguyen
(74) *Attorney, Agent, or Firm* — McCoy Russell LLP

(57) ABSTRACT

Hydraulic systems and methods comprising a source of hydraulic pressure; a hydraulic load; and an energy recovery circuit. The source of hydraulic pressure is fluidly connected to the hydraulic load through a first hydraulic channel with an orifice. The energy recovery circuit includes a recovery channel which is fluidly connected at its first end to the orifice on the side of it which is connected to the source of hydraulic pressure, and which is fluidly connected at its second end to a hydraulic motor.

9 Claims, 2 Drawing Sheets

(52) U.S. Cl.
CPC ..... *F15B 2211/6313* (2013.01); *F15B 2211/6323* (2013.01); *F15B 2211/665* (2013.01); *F15B 2211/763* (2013.01); *F15B 2211/88* (2013.01)

(56) References Cited

U.S. PATENT DOCUMENTS

| | | | | |
|---|---|---|---|---|
| 9,863,124 | B2 * | 1/2018 | Ishihara | B60W 20/13 |
| 10,280,593 | B2 * | 5/2019 | Hijikata | F15B 13/06 |
| 11,002,245 | B2 * | 5/2021 | Funk | H02P 9/06 |
| 2019/0136874 | A1 | 5/2019 | Olesen et al. | |

FOREIGN PATENT DOCUMENTS

| | | | |
|---|---|---|---|
| JP | 2004211779 | A | 7/2004 |
| JP | 2005140143 | A | 6/2005 |
| JP | 2005195102 | A | 7/2005 |
| JP | 2011144555 | A | 7/2011 |
| WO | 2013132721 | A1 | 9/2013 |

* cited by examiner

HYDRAULIC SYSTEM WITH AN ENERGY RECOVERY CIRCUIT

CROSS-REFERENCE TO RELATED APPLICATION

The present application claims priority to European Patent Application No. 19218465.3, entitled "HYDRAULIC SYSTEM WITH AN ENERGY RECOVERY CIRCUIT", and filed on Dec. 20, 2019. The entire contents of the above-listed application are hereby incorporated by reference in their entirety for all purposes.

TECHNICAL FIELD

The present document relates to the field of hydraulic machines and vehicles driven by hydraulic systems, and in particular to hydraulic drive systems offering the opportunity of recovering energy.

BACKGROUND AND SUMMARY

For a class of machines, for example working machines, hydraulic drives traditionally offer many advantages. For example, forklifts and other lifting devices as well as caterpillars and cranes are often driven hydraulically. It is already well known to provide extra aggregates in hydraulic systems and circuits in order to recover hydraulic energy.

For example, in US 2019/0136874 A1, a system is described with a hydraulic circuit, for example used in a forklift truck. A first hydraulic pump/motor is configured to provide pressurized fluid in order to drive a hydraulic lift mechanism. Potential energy of the before-lifted load can be recovered when the load is lowered and stored either as electric energy or hydraulic energy. For this purpose, a pressure relief valve is provided which allows hydraulic fluid pressurized by the load to flow to an energy recovery circuit. The described system thereby allows remaining energy of the load to be recovered after the work is done.

One of the goals of the present disclosure is to allow hydraulic energy in a hydraulic circuit to be recovered at different stages of the hydraulic working process.

It is another goal of the present disclosure to allow energy to be recovered during the hydraulic drive or working process.

The presently proposed hydraulic system comprises a source of hydraulic pressure, a hydraulic load, and an energy recovery circuit, wherein the source of hydraulic pressure is fluidly connected to the hydraulic load through a first hydraulic channel including an orifice, wherein the energy recovery circuit includes a recovery channel which is fluidly connected at its first end to the orifice on the side of it which is connected to the source of hydraulic pressure, and which is fluidly connected at its second end to a hydraulic motor which is mechanically coupled to an electric generator, an energy storage system, potentially a battery, coupled to the electric generator, a controller which is configured to control a hydraulic resistance of the recovery circuit based on the value of the hydraulic flow to the hydraulic load and/or a hydraulic pressure P10 at the hydraulic load or on a pressure drop across the orifice.

In ordinary use, the source of hydraulic pressure may drive the hydraulic load by delivery of high-pressurized hydraulic fluid through the first hydraulic channel. The source of hydraulic pressure therein may be a hydraulic pump or a hydraulic cylinder, any kind of hydraulic storage, or a source of hydraulic energy that itself may be configured to recover hydraulic energy from a braking process or from the process of lowering a load, for example in case of a fork lifter. The delivered hydraulic energy can be used to drive the hydraulic load. The hydraulic load may be a piston or a hydraulic motor, for example for lifting a weight or for performing any other kind of work that may be performed by hydraulic devices. It is a specific feature of the presently proposed hydraulic system that the first hydraulic channel which fluidly connects the source of hydraulic pressure with the hydraulic load includes an orifice. Within the scope of this document the term orifice is intended to refer to any kind of fluid connection that causes a pressure drop between the source of hydraulic pressure and the hydraulic load. Therefore, the orifice may but does not necessarily have to include a localized element in the form of a nozzle, a valve such as a throttle valve or similar element, but it may also be realized by a section of the first hydraulic channel with a limited cross section so that a pressure drop is generated when the hydraulic load is operated. More specifically, it may be provided that the pressure drop amounts to at least 1%, to at least 5% or to at least 10% of the pressure delivered by the source of hydraulic pressure.

The recovery channel which is fluidly connected at its first end to the orifice on the side of the orifice which is connected to the source of hydraulic pressure may lead pressurized hydraulic fluid from the source of hydraulic pressure to a hydraulic motor which is mechanically coupled to an electric generator. This way, excessive hydraulic energy that is generated or delivered by the source of hydraulic pressure and which is not needed to drive the hydraulic load can be recovered in the recovery circuit. The excessive energy therefore is used to drive a hydraulic motor which is coupled to the electric generator. The generator may transform the kinetic energy into electric energy which may then be stored in the energy storage system such as a battery.

Further, a controller is provided which is configured to prevent that too much energy is diverted from the source of hydraulic pressure to the recovery circuit and that too little of the hydraulic energy remains for driving the hydraulic load. For this purpose, the controller may be configured to control the resistance of the recovery circuit based either on the amount of hydraulic flow to the hydraulic load and/or based on the hydraulic pressure P10 which is provided at the hydraulic load, and/or based on a pressure drop between the two sides of the orifice.

The source of hydraulic pressure with its inherent hydraulic resistance, the hydraulic load, the orifice and the recovery circuit with its controllable hydraulic resistance form a hydraulic network. By controlling the hydraulic resistance of the recovery circuit, it is possible to control the flow through the orifice and the pressure P10 provided at the hydraulic load as well as the pressure drop across the orifice. Therefore, introducing the hydraulic resistance of the orifice allows controlling the amount of energy that is diverted or led from the source of hydraulic pressure to the recovery circuit.

In an embodiment of the presently proposed hydraulic system, it may be provided that the controller is connected to one or more hydraulic sensors wherein at least a first hydraulic sensor is located in the first hydraulic channel between the orifice and the hydraulic load or at the hydraulic load. The first hydraulic sensor may include a pressure sensor and/or a flow sensor.

In case the first hydraulic sensor includes a pressure sensor, it may measure or determine the pressure value P10, and the controller may be configured to control the hydraulic resistance of the recovery circuit such as to provide the minimum necessary pressure P10 required to drive the hydraulic load in an appropriate way.

If the first hydraulic sensor includes a flow sensor, the controller may use the measured value of the hydraulic flow to the hydraulic load in order to control the amount of energy which is diverted or led to the recovery circuit to provide the minimum necessary hydraulic flow to the hydraulic load which guarantees an appropriate function of the hydraulic load.

A further embodiment may provide that the controller is connected to a second hydraulic sensor wherein the second hydraulic sensor is located in the first hydraulic channel between the orifice and the source of hydraulic pressure, or at the source of hydraulic pressure, wherein the second hydraulic sensor may include a pressure sensor and may be configured to measure or determine the pressure value P11 and/or wherein the second hydraulic sensor may include a flow sensor.

By using the second hydraulic sensor, either the hydraulic flow to the hydraulic load through the orifice may be measured or the pressure at the hydraulic load may be calculated on the basis of the measured hydraulic pressure between the source of hydraulic energy and the orifice or, if both a first and second hydraulic sensor are provided on the two sides of the orifice, the pressure drop across the orifice may be measured and a controller may control the amount of hydraulic energy diverted or transferred to the recovery circuit based on the measured pressure drop across the orifice.

It may further be provided that the controller is connected to one or more hydraulic sensors through an electric or a hydraulic connection.

The controller may include an electric circuit comprising a processor, memory, and instructions to execute the functions described herein. The controller may be configured to receive signals from hydraulic sensors wherein the hydraulic sensors may be configured to measure hydraulic values such as a pressure or a fluid flow, and to convert these values into electric signals.

The output of the controller in this case may be an electric signal for electrically controlling an element of the hydraulic circuit, or for electrically controlling a generator or an electric converter.

Additionally or alternatively, the controller may work based on hydraulic sensors and/or actuators and may be at least partially realized in the form of a hydraulic control unit. In this case, the controller may be connected to hydraulic sensors by fluid channels and the signals may be transferred hydraulically driving pistons, valves or other hydraulic elements in the controller. The controller in this case may generate an output in the form of a hydraulic signal that may control a hydraulic device.

It may further be provided that the hydraulic motor is configured such that its hydraulic resistance is controlled by the controller. For example, the controller may be configured to control the hydraulic displacement of the hydraulic motor.

In this case, the controller may be configured to control a mechanical feature in the hydraulic motor such as a valve position or a position or angle of another mechanical element in the hydraulic motor, for example in order to change the hydraulic resistance of the hydraulic motor.

It may also be provided that the electric generator is configured such that its mechanical resistance is controlled by the controller.

For example, an excitation of a stator winding in the electric generator or an electric resistance in any electric conductor of the generator may be controlled by the controller. Thereby, on one hand, more or less electric energy may be derived from the source of hydraulic energy or the generator may work more or less efficiently and convert some share of the mechanical energy into thermal energy.

The hydraulic system is designed such that the hydraulic load receives the necessary minimum power which is required for the hydraulic load to function properly. If or when the source of hydraulic pressure provides more than said minimum power, any excess power may be diverted to and used by the recovery circuit. The fractions of the power provided by the source of hydraulic pressure that are or may be delivered to the hydraulic load and to the recovery circuit may be controlled by controlling the hydraulic resistance of the recovery circuit. For example, by increasing the hydraulic resistance of the recovery circuit, more hydraulic energy may be delivered from the source of hydraulic pressure to the hydraulic load. Similarly, by decreasing the hydraulic resistance of the energy recovery circuit, the amount of hydraulic energy delivered from the source of hydraulic pressure to the hydraulic load may be reduced.

In another implementation, it may also be provided that the controller may be configured to control an electrical converter which is electrically connected to the generator.

The controller may therein directly control the electrical converter by electric signals and thereby select the necessary or appropriate resistance of the hydraulic energy recovery circuit.

The controller may include an electrical circuit including a processor, memory, and instructions. The instructions may be executed to perform steps such as controlling the hydraulic resistance of the recovery circuit based on one or more of: the value of the hydraulic flow to the hydraulic load, the hydraulic pressure at the hydraulic load, and a pressure drop across the orifice. The controller may also comprise one or more pressure-controllable hydraulic valves.

The controller may, for example, be provided that one pressure controllable hydraulic valve is configured to fluidly connect and disconnect a first hydraulic steering chamber in a hydraulic cylinder with the recovery channel, wherein a second steering chamber of the hydraulic cylinder is continuously fluidly connected with the recovery channel and wherein the position of a steering element, in particular a steering piston in the hydraulic cylinder depends on a comparison of the pressure in the first and second steering chamber or on a pressure differential between the pressure in the first steering chamber and the pressure in the second steering chamber.

The controller in this embodiment may comprise a pressure-controllable hydraulic valve which may act on a hydraulic cylinder and steer an actuating piston in the hydraulic cylinder which may act on the hydraulic motor or an element of the hydraulic motor in order to change a hydraulic displacement and/or select a position of an element of the hydraulic motor and change or select the resistance of the motor. The input of the pressure controllable hydraulic valve may be provided by a pressure P10 at the hydraulic load which is or may be fluidly connected to an input channel of the pressure-controllable hydraulic valve and by a pressure at the source of hydraulic pressure which is or may also be fluidly connected to an input channel of the controllable hydraulic valve. The pressure controllable hydraulic valve may generate an output which depends on the difference between the pressure levels P11 and P10 at the load and at the source of hydraulic pressure and it may be a proportional valve.

Thereby, the pressure-controllable hydraulic valve may control the resistance of the recovery circuit based on the hydraulic pressure which is measured or determined at the hydraulic load or based on the pressure drop across the orifice.

BRIEF DESCRIPTION OF THE FIGURES

The presently proposed hydraulic system is further described and explained on the basis of figures of a drawing, wherein

FIGS. 1-3 are shown approximately to scale.

DETAILED DESCRIPTION

Figure 1:
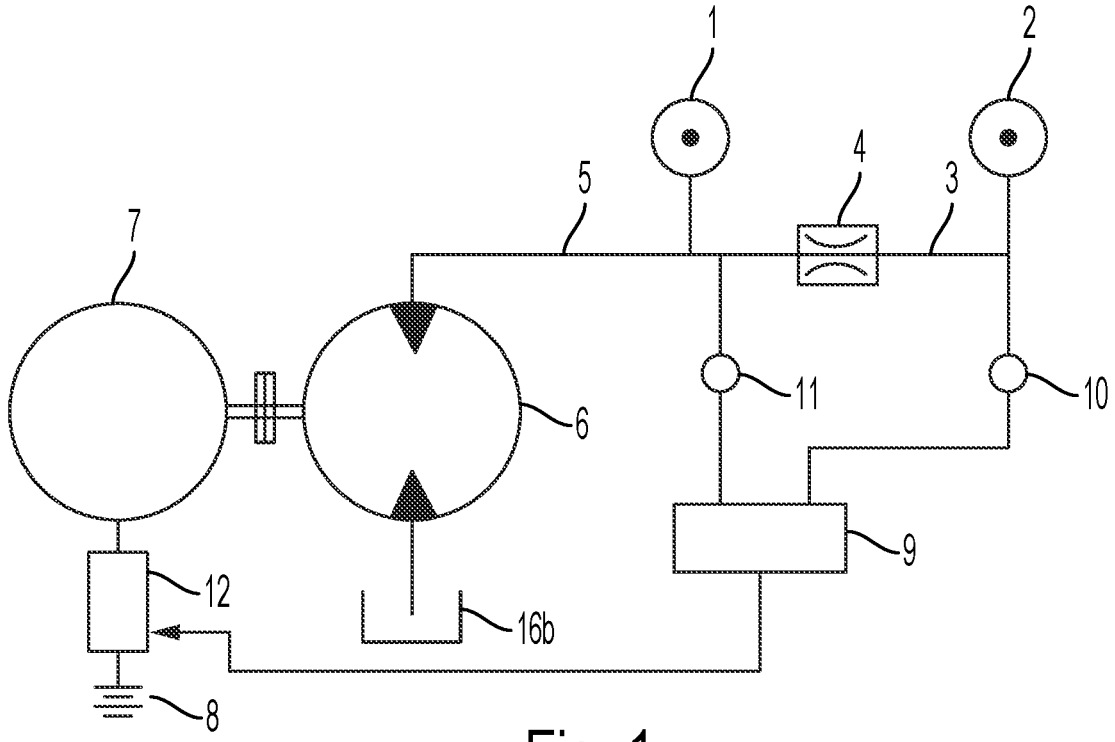
FIG. 1 shows a hydraulic circuit with a controller controlling an electric generator.

FIG. 1 shows a hydraulic system with a source 1 of hydraulic pressure which is fluidly connected with a hydraulic load 2 through a first hydraulic channel 3. The source of hydraulic pressure may be a hydraulic pump or a hydraulic piston or a high pressure hydraulic tank or any other source of hydraulic pressure. The hydraulic load 2 may be a hydraulic piston or a hydraulic motor or any other hydraulic element that may be driven by hydraulic pressure. The hydraulic load may be part of a fork lifter or another device for lifting or moving weights or may be a hydraulic tool like a hydraulic hammer.

The first hydraulic channel 3 includes an orifice 4 wherein the term orifice may refer to a localised valve such as a throttle valve with a reduced cross section that causes a pressure drop or to any other hydraulic element causing a pressure drop, such as a nozzle, a hydraulic channel with a reduced cross section, or the like. The source of hydraulic pressure 1 is fluidly connected with the second hydraulic sensor 11 while the load 2 is fluidly connected with the first hydraulic sensor 10. The first hydraulic sensor 10 may measure a hydraulic pressure or may be directly located between the orifice 4 and the hydraulic load and measure a hydraulic flow. The second hydraulic sensor 11 may measure a hydraulic pressure. It may as well be provided between the source of hydraulic pressure and the orifice 4 and may measure a hydraulic flow through the orifice.

The output lines of sensors 10, 11 may be electrically or hydraulically connected to the controller 9.

A hydraulic motor 6 is fluidly connected with the source of hydraulic pressure 1 through the channel 5. The hydraulic motor 6 may be driven by the pressurized hydraulic fluid from the source of hydraulic pressure 1. On its low pressure side, the hydraulic motor 6 is fluidly connected with a low pressure fluid tank 16B. The hydraulic motor 6 is mechanically coupled with an electric generator 7. When the hydraulic motor 6 is rotating, the electric generator 7, driven by the hydraulic motor, is rotating as well and generating electric energy. A converter 12 may convert this electric energy to a DC current which may be fed into a battery 8. The energy delivered by the hydraulic motor 6 may also be stored in any other way, e.g. by compressing a gas in a tank.

The converter 12 is directly controlled by the controller 9 in order to steer for example an excitation voltage of the generator 7 and control the resistance of the generator and thereby the mechanical resistance of the hydraulic motor 6. Thereby, the amount and share of hydraulic energy that is diverted or derived or drained from the source 1 of hydraulic pressure to the hydraulic motor 6 and therefore to the energy recovery circuit is controlled by the controller 9. In the same way, the share of hydraulic energy which is fed from the source 1 of hydraulic pressure to the load 2 is as well controlled by the controller 9.

Figure 2:
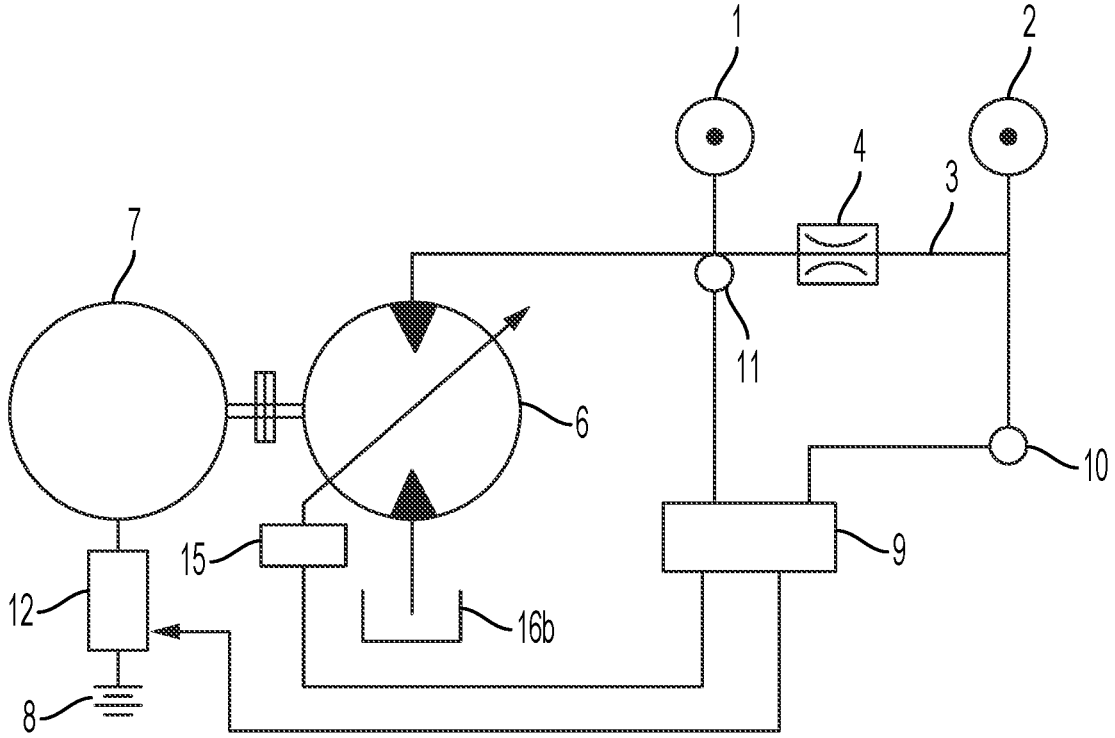
FIG. 2 shows a hydraulic circuit with a controller acting on a hydraulic motor and FIG. 3 shows a hydraulic circuit with a controller which is at least partially working hydraulically and acting on a hydraulic motor.

FIG. 2 shows a hydraulic circuit which is similar to the circuit shown in FIG. 1 but wherein the controller 9 not only acts on a converter 12 of the electric generator 7, but may as well act in addition or alternatively directly on the hydraulic motor 6. Therefore, the controller 9 is connected to the element 15 in an electric or hydraulic way when the element 15 may directly control an element of the hydraulic motor 6. Thereby, the position or angle of a mechanic element of the hydraulic motor 6, in particular the hydraulic displacement of the motor, may be controlled or as well a hydraulic valve at the entry or exit channel of the hydraulic motor 6. In effect, the resistance of an energy recovery part of the hydraulic circuit may be controlled and thereby the share of energy that is delivered to the load 2.

Figure 3:
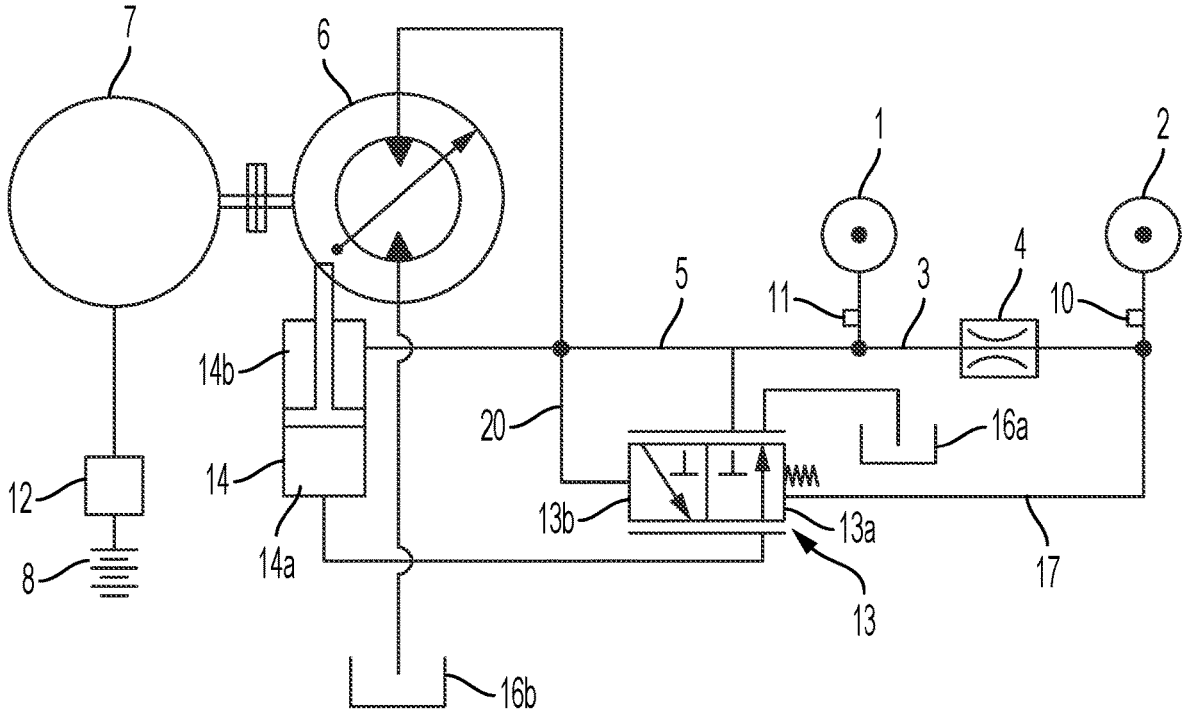

FIG. 3 shows a hydraulic system wherein the controller is realized at least partially in a hydraulic way at least comprising a pressure controlled hydraulic valve.

The hydraulic circuit comprises a source 1 of electric pressure which is fluidly connected with a hydraulic load 2 through a first hydraulic channel 3 and an orifice 4. Sensors 10, 11 may be provided as described above in order to measure the pressure values P10 (Sensor 10) and P11 (Sensor 11).

The output of the first source of hydraulic pressure 1 is fluidly connected through the channel 5 to the input channel of the hydraulic motor 6. The exit channel of the hydraulic motor 6 is fluidly connected with the low pressure fluid tank 16B.

The hydraulic motor is mechanically connected or coupled with the electric generator 7 which is controlled by the electric converter 12. The converter 12 is connected to an electric battery 8 where the recovered electric energy may be stored.

The controller 13 works as follows: The control valve has output channels one of which is connected with the source of hydraulic pressure 1, one of which is connected with a low pressure fluid tank 16*a*, and one of which is connected to a steering volume 14*a* of hydraulic cylinder 14. Further, the hydraulic load 2 is fluidly connected with a first control input/control channel 13*a* of the control valve 13 through a control channel 17. The source 1 of hydraulic pressure is fluidly connected through the channels 5 and 20 with the second control input/control channel 13*b* of the control valve 13. Hence, at the first control input 13*a*, the pressure value is P10 (measured by sensor 10) and at the second control input 13*b*, the pressure value is P11 (measured by sensor 11). The control valve controls its proportional pressure output to the steering chamber 14*a* based on the pressure difference between P10 and P11. If (P11−P10) <=threshold value P*, the control valve 13 remains in the position as shown in FIG. 3. This implies that the steering chamber 14*a* is fluidly connected with the low pressure fluid tank 16*b* and not with channel 5. If (P11−P10)>P*, the control valve 13 starts to move (it is a proportional valve) towards a second position, connecting channel 5 gradually more with the steering chamber 14*a*, thereby varying the hydraulic displacement of the hydraulic motor, reducing the resistance of the hydraulic motor and starting the energy recovery. When the pressure drop across the orifice increases, the hydraulic displacement of the hydraulic motor increases, the resistance of the hydraulic motor decreases and the share of recovered energy increases.

Thereby, the hydraulic circuit can easily be controlled by mainly hydraulic means and independent of electric means.

The hydraulic circuit according to the presently proposed hydraulic system allows for recovery of excessive hydraulic energy delivered by a source of hydraulic pressure even in the working phase of a hydraulic load 2.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A hydraulic system, comprising:

a source of hydraulic pressure;

a hydraulic load;

an energy recovery circuit, wherein the source of hydraulic pressure is fluidly connected to the hydraulic load through a first hydraulic channel including an orifice, wherein the energy recovery circuit includes a recovery channel which is fluidly connected at its first end to the orifice on the side of the orifice which is connected to the source of hydraulic pressure, and which is fluidly connected at its second end to a hydraulic motor, wherein the hydraulic motor is mechanically coupled to an electric generator; and a controller which is configured to control a hydraulic resistance of the recovery circuit based on the value of the hydraulic flow to the hydraulic load and/or a hydraulic pressure at the hydraulic load or on a pressure drop across the orifice, the controller controlling a position of a steering element depending on a comparison of pressures in a first steering chamber selectively fluidly connected to the recovery channel and a second steering chamber continuously fluidly connected with the recovery channel.

2. The hydraulic system according to claim 1, wherein the controller is connected to one or more hydraulic sensors wherein at least a first hydraulic sensor is located in the first hydraulic channel between the orifice and the hydraulic load or at the hydraulic load, wherein the first hydraulic sensor is configured to be a pressure sensor and/or a flow sensor.

3. The hydraulic system according to claim 2, wherein the controller is connected to a second hydraulic sensor wherein the second hydraulic sensor is located in the first hydraulic channel between the orifice and the source of hydraulic pressure or at the source of hydraulic pressure, wherein the second hydraulic sensor is configured to be a pressure sensor and/or a flow sensor.

4. The hydraulic system according to claim 3, wherein the controller is connected to one or more hydraulic sensors through an electric or a hydraulic connection.

5. The hydraulic system according to claim 1, wherein the hydraulic motor is configured such that its hydraulic resistance is controlled by the controller.

6. The hydraulic system according to claim 1, wherein the electric generator is configured such that its mechanical resistance is controlled by the controller.

7. The hydraulic system according to claim 6, wherein an electrical converter which is electrically connected to the generator, is controlled by the controller.

8. A method of operation of the hydraulic system according to claim 1, the method comprising:

during delivery of pressurized hydraulic fluid from the source of hydraulic pressure to the hydraulic load, controlling the hydraulic resistance of the recovery circuit with the controller based on one or more of: the value of the hydraulic flow to the hydraulic load, the hydraulic pressure at the hydraulic load, and a pressure drop across the orifice.

9. A hydraulic system, comprising:

a source of hydraulic pressure;

a hydraulic load;

an energy recovery circuit, comprising:

a first hydraulic channel including an orifice, the first hydraulic channel connecting the source of hydraulic pressure to the hydraulic load, and a recovery channel connected to the orifice at a first end and connected to a hydraulic motor at a second end; and a controller configured to control a hydraulic resistance of the recovery circuit based on one or more of a hydraulic flow to the hydraulic load, a hydraulic pressure at the hydraulic load, and a pressure drop across the orifice, the controller comprising one or more pressure controllable hydraulic valves, one pressure controllable hydraulic valve configured to fluidly connect and disconnect a first hydraulic steering chamber in a hydraulic cylinder with the recovery channel, a second steering chamber of the hydraulic cylinder continuously fluidly connected with the recovery channel, and a position of a steering element controlled depending on a comparison of the pressure in the first and second steering chamber.

* * * * *